US005229352A

United States Patent [19]

Beck et al.

[11] Patent Number: 5,229,352

[45] Date of Patent: Jul. 20, 1993

[54] THERMAL TRANSFER RECEIVER

[75] Inventors: Nicholas C. Beck; Paul A. Edwards, both of Essex; Richard A. Hann, Suffolk, all of England

[73] Assignee: Imperial Chemical Industries PLC, London, England

[21] Appl. No.: 697,348

[22] Filed: May 9, 1991

[30] Foreign Application Priority Data

May 14, 1990 [GB] United Kingdom ..... 9010756

[51] Int. Cl.[5] ..... B41M 5/035; B41M 5/38

[52] U.S. Cl. ..... 503/227; 428/195; 428/447; 428/480; 428/913; 428/914

[58] Field of Search ..... 8/471; 428/195, 913, 428/914, 480, 447; 503/227

[56] References Cited

U.S. PATENT DOCUMENTS 5,028,503 7/1991 Chang ..... 430/281

*Primary Examiner*—B. Hamilton Hess

*Attorney, Agent, or Firm*—Cushman, Darby & Cushman

[57] ABSTRACT

In a thermal transfer print, the ready diffusion of dyes through the receiver layer, which is necessary for effecting their thermal transfer from a dyesheet during printing, can also lead to subsequent diffusion within the print, with consequent degradation of print quality. This form of print instability is now countered by using a receiver layer comprising a dye-receptive polymer composition doped with a print stabilizer consisting of a toluene sulphonamideformaldehyde condensation product.

12 Claims, No Drawings

THERMAL TRANSFER RECEIVER

The invention relates to thermal transfer printing, and especially to receivers having improved print stability.

Thermal transfer printing is a generic term for processes in which one or more thermally transferable dyes are caused to transfer from a dyesheet to a receiver in response to thermal stimuli. Using a dyesheet comprising a thin substrate supporting a dyecoat containing one or more dyes uniformly spread over an entire printing area of the dyesheet, printing can be effected by heating selected discrete areas of the dyesheet while the dyecoat is pressed against a dye-receptive surface of a receiver sheet, thereby causing dye to transfer to corresponding areas of the receiver. The shape of the pattern transferred is determined by the number and location of the discrete areas which are subjected to heating. Full colour prints can be produced by printing with different coloured dyecoats sequentially in like manner, and the different coloured dyecoats are usually provided as discrete uniform print-size areas in a repeated sequence along the same dyesheet.

High resolution photograph-like prints can be produced by thermal transfer printing using appropriate printing equipment, such as a programmable thermal print head or laser printer, controlled by electronic signals derived from a video, computer, electronic still camera, or similar signal generating apparatus. A typical thermal print head has a row of tiny heaters which prints six or more pixels per millimeter, generally with two heaters per pixel. The greater the density of pixels, the greater is the potential resolution, but as presently available printers can only print one row at a time, it is desirable to print them at high speed with short hot pulses, usually from near zero up to about 10 ms long, but even up to 15 ms in some printers, with each pixel temperature typically rising to about 350° C. during the longest pulses.

Receiver sheets comprise a sheet-like substrate supporting a receiver coat of a dye-receptive composition containing a material having an affinity for the dye molecules, and into which they can readily diffuse when the adjacent area of dyesheet is heated during printing. Such receiver coats are typically around 2–6 μm thick, and are generally based on organic dye-receptive polymers, soluble in common solvents to enable them readily to be applied to the substrate as coating compositions and then dried to form the receiver coat.

The ability of the dyes to diffuse into the dye-receptive polymers from the dyecoat when the back of the dyesheet is heated, is a fundamental requirement for thermal transfer printing. However, this same ability enables the dyes to diffuse through the receiver coat in other directions, and can thus lead to subsequent migration through the resultant print, unless the print is suitably stablished. An effect of such migration can be accumulation of the dye at the receiver surface. Grease at the surface tends to exacerbate this effect and such instability can manifest itself annoyingly when the prints are handled. Clearly visible finger prints may develop where the printed surface has come into contact with fingers sufficiently to leave traces of grease on the print surface. Under normal ambient conditions, such fingerprints may take some time to develop, e.g. several weeks, making this effect difficult to quantify, but by using particularly susceptible dyes under hot humid conditions, this may be accelerated to the extent that quite visible fingerprints can develop on the surface of a print within just a few days. This has enabled us quantitatively to evaluate this problem, measuring fingerprints as a change in the optical density of the print at that point, and further to evaluate ways of stabilising the print. We have now found that such print instability may be alleviated by the addition of certain formaldehyde condensation products to the composition of the receiver coat.

Accordingly, one aspect of the present invention provides a receiver sheet for thermal transfer printing, comprising a sheet-like substrate supporting a receiver layer comprising a dye-receptive polymer composition doped with a print-stabiliser consisting of a toluene sulphonamide-formaldehyde condensation product.

Examples of toluene sulphonamide-formaldehyde condensation products commercially available include those sold by AKZO Chemicals BV, under the registered trade name "Ketjenflex". These are sold in two grades, Ketjenflex MH (hard, nearly colourless resin flakes) and Ketjenflex MS-80 (a light coloured viscous liquid).

The invention may be used with any of the more commonly used dye-receptive polymers, whether this be a single species of polymer, or a mixture. Examples of suitable polymers include polycarbonates, polyvinylbutyral, styrene/acrylonitrile copolymers and saturated polyesters. The invention is particularly applicable to the latter, as these are generally preferred for most applications on account of their high dye-acceptability, which in turn makes them particularly vulnerable to the very instabilities to which this invention is directed. Examples of the latter polymers which are commercially available, include Vitel PE 200 (Goodyear), and Vylon polyesters (Toyobo), especially grades 103 and 200.

The selection of the dye-receptive polymer, both in terms of its chemistry and its physical properties, is an important factor in determining print quality. When similar polymers of different Tgs are used as the dye-receptive polymer, we find that those with the lower Tgs tend generally to give higher achievable optical densities. However, they are also more likely to suffer from low temperature transfer problems. Low temperature transfer is an effect that can occur in a printer that has become warmed overall by the printing operation, to the degree that some dye becomes transferred by the general warmth of the printer, in addition to that transferred in specific places by selective heating of the print head heaters. The effect of this is to degrade the print quality, and hence in selecting the Tg, the optical density requirements need to be balanced against the possibilities of low temperature transfer.

The proportion of print stabiliser relative to dye-receptive polymer, surprisingly appears not to be at all critical to such desirable print properties as high achievable optical density, in the final print. Even very small amounts of the print stabiliser of the present invention, e.g. 2% by weight of the dye-receptive polymer, may give noticeable improvement of the print stability, this effect increasing with increasing stabiliser concentration. Too high a proportion of stabiliser may start to affect print colour with some dyes, but we have not noticeably suffered this until stabiliser proportions have well exceeded three times the weight of the dye-receptive polymer. We have also been surprised to notice how little has the optical density been reduced when high proportions of the dye-receptive polymer have been replaced by the present print stabilisers. Indeed our generally useful range of stabiliser proportions is very broad, being 2.5–250% by weight of the dye-receptive polymer. With most polymers, however, we generally prefer to use comparable quantities of polymer and stabiliser, e.g. within a factor of two either way (i.e. stabiliser weight being 50–200% by weight of the dye-receptive polymer), the proportion chosen depending largely on the polymer being used.

However, with some dye-receptive polymers, the upper limits of stabiliser which can be added are governed by its solubility within the coating solution. Thus for some saturated polyesters, solubility problems start to become noticeable around 20–25% by weight of the dye-receptive polymer. For these, our generally preferred range is 2.5–20% by weight of the dye-receptive polymer, beyond the upper limit of which solubility problems may arise without any noticeable further gains in print stability. We particularly prefer to use the stabiliser in amounts of at least 5% by weight of such dye-receptive polymers, and for most polyester systems, more than 10% seems to have little additional beneficial effect with polyesters.

Thermoplastic dye-receptive polymers generally have softening temperatures below the temperatures that can be reached during printing. Although the printing pulses are so short, they can be sufficient to cause a degree of melt bonding between the dyecoat and receptive layer, the result being total transfer to the receiver of whole areas of the dyecoat. The amount can vary from just a few pixels wide, to the two sheets being welded together over the whole print area.

To overcome such total transfer problems arising during printing, various release systems have been proposed, including systems comprising silicones and a cross-linking agent, which can be incorporated into the receiver coating composition with the dye-receptive material. Cross-linking is then effected after the composition has been coated onto the substrate to form the receiver layer. This cross-linking stabilises the layer and prevents the silicone migrating.

Our preferred release system comprises a thermoset reaction product of at least one silicone having a plurality of hydroxyl groups per molecule and, as cross-linking agent, at least one organic polyfunctional N-(alkoxymethyl) amine resin reactive with such hydroxyl groups under acid catalysed conditions.

The hydroxyl groups can be provided by copolymerising a silicone moeity with a polyoxyalkylene to provide a polymer having molecules with terminal hydroxyls, these being available for reaction with the amino resins. Difunctional examples of such silicone copolymers include polydimethylsiloxane polyoxyalkylene copolymers, and to obtain the multiple cross-linking of a thermoset product, these require an N-(alkoxymethyl) amine resin having a functionality of at least 3. Hydroxyorgano functional groups can also be grafted directly onto the silicone backbone to produce a cross-linkable silicone suitable for the composition of the present invention. Examples of these include Tegomer HSi 2210, which is a bis-hydroxyalkyl polydimethylsiloxane. Again having a functionality of only 2, a cross-linking agent having a greater functionality is required to achieve a thermoset result.

Preferred polyfunctional N-(alkoxymethyl) amine resins include alkoxymethyl derivatives of urea, guanamine and melamine resins. Lower alkyl compounds (i.e. up to the $C_4$ butoxy derivatives) are available commercially and all can be used effectively, but the methoxy derivative is much preferred because of the greater ease with which its more volatile by-product (methanol) can be removed afterwards. Examples of the latter which are sold by American Cyanamid in different grades under the registered trade name "Cymel", are the hexamethoxymethylmelamines, suitably used in a partially prepolymerised form (as oligomers) to obtain appropriate viscosities. Hexamethoxymethylmelamines are 3–6 functional, depending on the steric hindrance from substituents and are capable of forming highly cross-linked materials using suitable acid catalysts, e.g. p-toluene sulphonic acid (PTSA). However, the acids are preferably blocked when first added, to extend the shelf life of the coating composition, examples include amine-blocked PTSA (e.g. Nacure 2530) and ammonium tosylate.

Preferred receiver coats contain only the minimum quantity of the silicone that is effective in eliminating total transfer. This varies with the silicone selected for use. Some can be effective below 0.2%, with a practical minimum for the best of those so far tried, seeming to be about 0.16% by weight of the dye-receptive polymer. Silicone quantities as high as 5% by weight of the polymer may start to show the instability problems referred to above, and less than 2% is generally to be preferred. We find also that any free silicone may lead to total transfer problems, and prefer to use at least an equivalent amount of the polyfunctional amine resin cross-linking agent.

Our preferred receiver coat is one in which the print-stabiliser also is cross-linked. We find that we can then use dye receptive polymers of lower Tg (to increase the achievable optical density as described above) without incurring low temperature transfer problems.

This effect is particularly noticeable when using saturated polyesters as the dye-receptive polymer. Taking as examples the grades of Vylon polyesters referred to above, Vylon 103 has a Tg lower than that of Vylon 200, and generally gives prints of higher optical density (the manufacturers quoting the Tg values as 47° and 67° C. respectively, ±4° C.). Intermediate Tgs can be obtained by mixing appropriate amounts of the two Vylon polymers. For higher overall Tgs, Vylon 290 (Tg 77° C. ±4° C.) may be used alone or in combination with the others. With the stabiliser cross-linked, we generally prefer to use polyesters whose overall Tg lies within the range 43°–71° C., although the Tg does not have to be this low to obtain the other benefits provided by cross-linking of the stabiliser. However, where the stabilisers are not cross-linked, we prefer our polyesters to have overall Tg values within the higher range of 50°–80° C., in order to reduce the likelihood of low temperature thermal transfer as described above.

When providing a cross-linked stabiliser system, both the print stabiliser and a cross-linking agent therefor, are incorporated into the receiver coating composition containing the dye-receptive material and any release system, and cross-linking is effected after the composition has been coated onto the substrate to form the receiver coat. The cross linking reaction for both the release system and the stabiliser thus take place at the same time within the receiver composition, after it has been applied to the substrate. Hence, the two cross linking systems must be compatible, and require essentially the same conditions.

The toluene sulphonamide-formaldehyde condensation products of the present invention are reactive under acid conditions with the cross-linking agents described above for our release system, and our preferred cross-linking agents for the print stabilisers are the same organic polyfunctional N-(alkoxymethyl) amine resins that are used for the release system.

As will therefore be appreciated, when using our preferred release system, it is inevitable that there will be some cross-linking of the print stabiliser by the cross-linking agent added for the release system. The effect will be competition for the cross-linker between the release system polyol and the present condensation product. This is generally not too significant as most of the silicone will be located at the surface, but some increase in total transfer during printing may become noticeable, unless additional amounts of cross-linking agent are added. To avoid such total transfer problems, we prefer to use an amount which theoretically should fully cross-link both the release system and the stabiliser. In practice, we find that some stabiliser may then still be leachable, indicating that it is not in fact fully cross-linked. When using saturated polyesters having print-stabilisers within the above preferred range of 2.5–20% by weight of the polyester, our preferred concentration for the polyfunctional N-(alkoxymethyl) amine resins, lies within the range 4–10% by weight of the saturated polyester.

We have also found a further form of instability which may be reduced by the use of the present print-stabilisers. This is instability triggered by mechanical damage. After general handling, this often takes the form of meandering lines of low optical density in the printed regions, having the appearance of snail tracks (by which term it is sometimes consequently identified, including herein). Other forms of mechanical damage may similarly manifest themselves in other visible shapes corresponding to the shape of the damage. Like the fingerprints above, snail tracks are also believed to be formed by selective crystallisation, but triggered by mechanical stress rather than the grease of the finger prints. The two instabilities are also similar in taking time to develop, this development period being reduced in both cases by accelerated aging in hot humid conditions. The effectiveness is such that we have not found any snail tracks in any of the prints we have made using receivers incorporating the present print stabilisers in the concentrations referred to above.

Various sheet-like materials have been suggested for the substrate, including for example, cellulose fibre paper, thermoplastic films such as biaxially orientated polyethyleneterephthalate film, plastic films voided to give them paper-like handling qualities (hence generally referred to as "synthetic paper"), and laminates of two or more such sheets.

With most paper-based substrates that do not themselves tend to hold surface charges of static electricity, the provision of so thin a coating of organic polymer does not usually lead to static-induced problems. However, receiver sheets based on thermoplastic films, synthetic papers and some cellulosic papers that are dielectric materials, readily build up charges of static electricity on their exposed surfaces, unless provided with some antistatic treatment. This in turn leads to poor handling properties generally, and especially when stored in packs of unused receiver sheets and stacks of prints made from them, i.e. when individual sheets may be moved relative to adjacent sheets with which they are in contact. Such sheets tend to stick together rather than slide easily one sheet over another.

This problem can be alleviated by using a receiver sheet having an antistatic treatment on both sides. The antistatic treatment on the receptor side preferably comprises a conductive subcoat located between the substrate and the receiver layer of dye-receptive material, and comprising a cross-linked organic polymer. A particularly effective conductive subcoat is one in which the polymer contains plurality of ether linkages and is doped with an alkali metal salt to provide conductivity. Lithium salts of organic acids are particularly suitable.

Having regard to the nature of the present receiver layer, our preferred subcoat polymers are acid catalysed reaction products of polyalkylene glycols with a polyfunctional cross-linking agent reactive with the terminal hydroxyls of the polyalkylene glycols. Cross-linking agents can then include the polyfunctional N-(alkoxymethyl) amine resins described above for use in the receiver coat, e.g. Cymel hexamethoxymethylmelamines or oligomers thereof. Indeed, we particularly prefer that the cross-linking agent used in the conductive subcoat be essentially the same as that of the receptive layer. This provides better adhesion between the two coatings. By "essentially the same" we have in mind that a different grade of Cymel may be desirable to adjust the viscosity during coating, for example, while retaining essentially the same chemical characteristics, and it is intended that such related compounds be included.

Receiver sheets may also have at least one backcoat on the side of the substrate remote from the receiver coat. Backcoats may provide a balance for the receiver coat, to reduce curl during temperature or humidity changes. They can also have several specific functions, including improvements in handling characteristics by making them conducting (the combination of a conducting backcoat and a conducting undercoat on the receiver side of the substrate being particularly effective), and by filling them with inert particles enabling the back of the print to be written upon.

Receiver sheets according to the first aspect of the invention can be sold and used in the configuration of long strips packaged in a cassette, or cut into individual print size portions, or otherwise adapted to suit the requirements of whatever printer they are to be used with (whether or not this incorporates a thermal print head or alternative printing system), to take full advantage of the properties provided hereby.

According to a second aspect of the invention, we provide a stack of print size portions of a receiver sheet according to the first aspect of the invention, packaged for use in a thermal transfer printer. The stacks provide a supply of receiver sheets having both release and stability advantages during and after printing, as described above. When the receiver coat is applied over a conductive layer, the sheets may be fed individually from the stack to a printing station in a printer, unhindered by static-induced blocking. There is also less risk of dust pick-up.

EXAMPLES

To illustrate the invention, a series of receiver sheets was prepared. In each case, a web of transparent biaxially orientated polyester film (as substrate) was provided on one side with a conductive undercoat overlayed with a receiver coat, and with a conductive backcoat on the other, as described below.

The first coat to be applied to the web was the backcoat. One surface of the web was first chemically etched to give a mechanical key. A coating composition was prepared as follows:

| | |
|---|---|
| acetone/ diacetone alcohol | 11/1 mixed solvent with trace of isopropanol |
| VROH | 42 parts by weight |
| Cymel 303 | 15 parts by weight |
| amine-blocked PTSA | 10 parts by weight |
| $LiNO_3$ | 1 parts by weight |
| Diakon MG102 | 22 parts by weight |
| Gasil EBN | 2 parts by weight |
| Syloid 244 | 8 parts by weight |

(VROH is a solvent-soluble terpolymer of vinyl acetate, vinyl chloride and vinyl alcohol sold by Union Carbide, Gasil EBN and Syloid 244 are brands of silica particles sold by Crosfield and Grace respectively, and Diakon MG102 is a polymethylmethacrylate sold by ICI).

The backcoat composition was prepared as three solutions, these being thermoset precursor, antistatic solution and filler dispersion. Shortly before use, the three solutions were mixed to give the above composition. This was then machine coated onto the etched surface, dried and cured to form a 1.5–2 μm thick backcoat.

For the receiver side of the substrate, a conductive undercoat composition was prepared consisting of:

| | |
|---|---|
| methanol | (solvent) |
| PVP K90 | 20 parts by weight |
| Cymel 303 | 40 parts by weight |
| K-Flex 188 | 5 parts by weight |
| digol | 15 parts by weight |
| PTSA | 20 parts by weight |
| $LiOH.H_2O$ | 3.2 parts by weight |

(K-Flex is a polyester polyol sold by King Industries and PVP is polyvinyl pyrrolidone, both being added to adjust the coating properties. Digol is diethyleneglycol)

This composition was machine coated onto the opposite side of the substrate from the backcoat, dried and cured to give a dry coat thickness of about 1 μm.

The receiver layer coating composition also used Cymel 303 and an acid catalysed system compatible with the conductive undercoat, and consisted of:

| | |
|---|---|
| toluene/MEK | 60/40 solvent mixture |
| Dye-receptive polymer Ketjenflex MH | (as specified in the table) |
| Tegomer HSi 2210 | 0.7 parts by weight |
| Cymel 303 | 1.4 parts by weight |
| Tinuvin 900 | 1.0 parts by weight |
| amine-blocked PTSA | 0.4 parts by weight |

(Tegomer HSi 2210, sold by Th Goldschmidt, is a bis-hydroxyalkyl polydimethylsiloxane, cross-linkable by the Cymel 303 under acid conditions to provide a release system effective during printing.)

This coating composition was made by mixing three functional solutions, one containing the dye-receptive Vylon, Ketjenflex and the Tinuvin UV absorber, a second containing the Cymel cross linking agent, and the third containing both the Tegomer silicone release agent and the amine-blocked PTSA solution to catalyse the cross-linking polymerisation between the Tegomer and Cymel materials. Using in-line machine coating, the receiver composition was coated onto the conductive layer about 4 μm thick.

Table I below shows the quantities of dye-receptive polymer and stabiliser expressed as parts by weight, with the latter also expressed (in brackets) as % by weight of the dye-receptive polymer. In Examples 12–15, additional Cymel was added to cross-link the Ketjenflex, the total amount of Cymel thus being 6% by weight of the dye-receptive polymer.

TABLE 1

| EXAMPLE | DYE-RECEPTIVE POLYMER VYLON 200 | | 103 | STABILISER KETJENFLEX MH | | EXTRA X-LINKER CYMEL 303 |
|---|---|---|---|---|---|---|
| 1 | 97.6 | | — | 2.4 | (2.5) | — |
| 2 | 97.1 | | — | 2.9 | (3.0) | — |
| 3 | 95.2 | | — | 4.8 | (5.0) | — |
| 4 | 93.1 | | — | 6.9 | (7.5) | — |
| 5 | — | | 90.0 | 10.0 | (11.0) | — |
| 6 | 42.5 | (50/50) | 42.5 | 15.0 | (18.6) | — |
| 7 | 74.0 | (80/20) | 18.5 | 7.5 | (8.1) | — |
| 8 | 55.5 | (60/30) | 37.0 | 7.5 | (8.1) | — |
| 9 | 66.25 | (50/50) | 66.25 | 7.5 | (8.1) | — |
| 10 | 37.0 | (40/60) | 55.5 | 7.5 | (8.1) | — |
| 11 | 18.5 | (20/80) | 74.0 | 7.5 | (8.1) | — |
| 12 | 9.0 | (10/90) | 84.0 | 7.0 | (7.5) | 4.6 |
| 13 | 28.0 | (30/70) | 65.0 | 7.0 | (7.5) | 4.6 |
| 14 | 56.0 | (60/40) | 37.0 | 7.0 | (7.5) | 4.6 |
| 15 | 27.5 | (30/70) | 65.0 | 7.5 | (8.1) | 4.6 |

The resulting receiver sheets were printed, and tested for fingerprint development using fingers from six different people in each Example. A sample from each Example was contacted with the fingers, and placed in a heated humid chamber to accelerate the fingerprint development, the conditions being 45° C. and 85% relative humidity. The resulting fingerprints were examined visually, and the optical density was measured. A control example having no Ketjenflex was also prepared fingered and exposed to the same warm humid conditions. The optical density was then measured, and any changes in the regions contacted by the six fingers, were compared with the changes measured for the samples from each of the Examples. The results were as follows:

EXAMPLE 1

Compared with the control, some improvement in stability against fingerprint development was observed. Measured change in optical density was half that of the control.

EXAMPLE 2

Similar to Example 1.

EXAMPLE 3

Very good visual improvement.

EXAMPLE 4

Best visual performance of this set.

EXAMPLE 5

Poor low temperature thermal transfer performance.

EXAMPLE 6

Efforts to improve the low temperature thermal transfer performance of the previous example failed. This was thought to be due to the use of very high concentrations of the Ketjenflex (low Tg) without provision of additional Cymel cross-linking agent (see Example 9 results below).

EXAMPLE 7

Very good low temperature thermal transfer performance.

EXAMPLE 8

Good low temperature thermal transfer performance.

EXAMPLE 9

Much improved low temperature thermal transfer performance when compared with Example 6, which also had equal portions of the two polyesters, but not as good as Example 8.

Example 10

Fairly poor low temperature thermal transfer performance.

EXAMPLE 11

Poor low temperature thermal transfer performance. All samples of Examples 7–11 had very good visual and measured resistance to fingerprint development, and no snail trails were seen.

EXAMPLE 12

Fairly poor low temperature thermal transfer performance.

EXAMPLE 13

Quite good low temperature thermal transfer performance.

EXAMPLE 14

Good low temperature thermal transfer performance.

EXAMPLE 15

Quite good low temperature thermal transfer performance. Good print stability, both visual and measured performance.

EXAMPLES 16–20

A further set of five experiments was carried out with different formulations, the coating compositions, receiver sheets and prints being prepared in the manner described above, and the resulting prints were tested in the same warm and humid conditions to accelerate the effects of any print instabilities. In the summary below, the quantities are expressed as percentages by weight of the dye-receptive polymer.

EXAMPLE 16

Composition: 50% Vylon 200, 50% Vylon 103, 25% Ketjenflex MH.
Result: solubility problems.

EXAMPLE 17

Composition: 100% Vylon 200, 25% Ketjenflex MH.
Result: solubility problems.

EXAMPLE 18

Composition: 60% Vylon 200, 40% Vylon 103, 7.5% Ketjenflex MH, 4% Cymel 303.
Result: Quite good low temperature thermal transfer performance.

EXAMPLE 19

Composition: 60% Vylon 200, 40% Vylon 103, 7.5% Ketjenflex MH, 6% Cymel 303.
Result: Good low temperature thermal transfer performance.

EXAMPLE 20

Composition: 60% Vylon 200, 40% Vylon 103, 7.5% Ketjenflex MH, 8% Cymel 303.
Result: Very good low temperature thermal transfer performance, but lower optical density build up during printing.

EXAMPLES 21–29

In this further series of nine Examples, dye-receptive polymers other than saturated polyesters were employed as indicated in Table 2 below, which shows the quantities of dye-receptive polymer and print-stabiliser expressed as parts by weight, with the latter also expressed (in brackets) as % by weight of the dye-receptive polymer. The release system had a lower silicone content, and the acid catalyst was again an amine blocked PTSA, though from a different manufacturer. The proportions were

| | |
|---|---|
| Tegomer 2311 | 0.4 parts by weight |
| Cymel 303 | 1.4 parts by weight |
| amine-blocked PTSA | 0.4 parts by weight |

TABLE 2

| EXAMPLE | DYE-RECEPTIVE POLYMER parts by weight | STABILISER KETJENFLEX MH (& expressed as weight % of polymer) |
|---|---|---|
| 21 | polyvinylacetoacetal 50 | 50 (100) |
| 22 | polyvinylbutyral BX5 50 | 50 (100) |
| 23 | polyvinylbutyral BX5 40 | 60 (150) |
| 24 | polyvinylbutyral BX5 35 | 65 (186) |
| 25 | polyvinylbutyral Butvar B90 40 | 60 (150) |
| 26 | Styrene/acrylonitrile copolymer 40 | 60 (150) |
| 27 | polycarbonate (Lexan) 33 | 67 (203) |
| 28 | polycarbonate 164R 80 | 20 (25) |
| 29 | polymethylmethacrylate 50 | 50 (100) |

The coating compositions, receiver sheets and prints were prepared in the manner described above, and the resulting prints were tested in the same warm and humid conditions to accelerate the effects of any print instabilities. The optical densities (ODs) of prints made using magenta and cyan dyes were measured, and the prints examined for total transfer. The results are shown below, in Table 3.

No total transfer was observed with any of these receivers. Excellent OD values were obtained with both magenta and cyan dyes, so no yellow prints were made as these also would be expected to give good OD values when good OD values are obtained with the other two colours, especially magenta.

TABLE 3

| EXAMPLE | OD MAGENTA | OD CYAN | LOW TEMPERATURE TRANSFER | FINGERPRINT TEST |
|---|---|---|---|---|
| 21 | — | 1.5 | very good | — |
| 22 | — | 1.7 | very good | — |
| 23 | 1.9 | 1.9 | very good | average |
| 24 | 2.0 | 2.0 | very good | good |
| 25 | 2.0 | 2.1 | good | very good |
| 26 | 2.0 | 2.1 | excellent | — |
| 27 | 2.0 | 2.1 | good | average |
| 28 | 1.8 | 2.0 | very good | — |
| 29 | 1.7 | 1.8 | very good | — |

We claim:

1. A receiver sheet for thermal transfer printing, comprising a substrate supporting a receiver layer comprising a dye-receptive polymer composition doped with a print stabiliser consisting of a toluene sulphonamide-formaldehyde condensation product.

2. A receiver sheet as claimed in claim 1, wherein the amount of print stabiliser is within the range 2.5–250% by weight of the dye-receptive polymer.

3. A receiver sheet as claimed in claim 1, wherein the dye-receptive polymer is a saturated polyester.

4. A receiver sheet as claimed in claim 3, wherein the amount of print stabiliser is within the range 2.5–20% by weight of the saturated polyester.

5. A receiver sheet as claimed in any one of the preceding claims, wherein the print-stabiliser is cross-linked.

6. A receiver sheet as claimed in claim 5, wherein said receiver layer includes a release system which comprises a thermoset reaction product of at least one silicone having a plurality of hydroxyl groups per molecule and, as cross-linking agent, at least one organic polyfunctional N-(alkoxymethyl) amine resin reactive with such hydroxyl groups under acid catalysed conditions.

7. A receiver sheet as claimed in claim 6, wherein the cross-linking agent for the print-stabiliser is the same as that used for the release system.

8. A receiver sheet as claimed in claim 7, wherein the cross-linking agent is a hexamethoxymethylmelamine or oligomer thereof.

9. A receiver sheet as claimed in claim 6, wherein the concentration of the polyfunctional N-(alkoxymethyl) amine resin lies within the range 4–10% by weight of the saturated polyester.

10. A receiver sheet as claimed in claim 3, wherein the print-stabiliser is substantially cross-linked, and the saturated polyester has a Tg within the range 43°–71° C.

11. A receiver sheet as claimed in claim 1, having an antistatic treatment on both sides, the antistatic treatment on the receptor side comprising a conductive subcoat located between the substrate and the layer of dye-receptive material, and comprising an organic polymer cross-linked by a polyfunctional N-(alkoxymethyl) amine resin.

12. A stack of print size portions of a receiver sheet as claimed claim 1, packaged for use in a thermal transfer printer.

* * * * *